United States Patent [19]

Stickel

[11] Patent Number: 4,602,884

[45] Date of Patent: Jul. 29, 1986

[54] PRINTING DEVICE INCLUDING PIVOTABLE AUXILIARY PAPER FEEDER

[75] Inventor: Heinz Stickel, Groebenzell, Fed. Rep. of Germany

[73] Assignee: Siemens Aktiengesellschaft, Berlin & Munich, Fed. Rep. of Germany

[21] Appl. No.: 651,959

[22] Filed: Sep. 19, 1984

[30] Foreign Application Priority Data

Oct. 3, 1983 [DE] Fed. Rep. of Germany ... 8328370[U]

[51] Int. Cl.[4] ..... B41J 11/58

[52] U.S. Cl. ..... 400/624; 400/647.1; 271/162

[58] Field of Search ..... 400/624, 616.1, 647.1; 271/162, 163, 241

[56] References Cited

U.S. PATENT DOCUMENTS

| | | | |
|---|---|---|---|
| 2,152,507 | 3/1939 | Trainor | 101/115 |
| 2,943,565 | 7/1960 | Malek | 101/126 X |
| 4,165,069 | 8/1979 | Colglazier et al. | 271/162 |

FOREIGN PATENT DOCUMENTS

| | | | |
|---|---|---|---|
| 2856950 | 8/1982 | Fed. Rep. of Germany . | |
| 207562 | 8/1938 | Switzerland | 271/162 |
| 1430810 | 4/1976 | United Kingdom | 271/162 |

OTHER PUBLICATIONS

IBM Technical Disclosure Bulletin, "Mechanism for Latching a Paper Sheet Feeder to a Typewriter", by Dunning, vol. 24, No. 7B, 12-81.

*Primary Examiner*—Edgar S. Burr
*Assistant Examiner*—John A. Weresh
*Attorney, Agent, or Firm*—Hill, Van Santen, Steadman & Simpson

[57] ABSTRACT

A line printer including a paper feeder channel disposed in the housing for the acceptance and feed of a recording medium to be printed is provided with an auxiliary paper feeder positionable on the paper feeder channel, whereby the auxiliary paper feeder is pivotally secured to the printer via a pivot pin. The pivot pin attachment contains a height adjustment device which lowers the auxiliary paper feeder over the paper feeder channel in its pivoted-in condition such that the feeder is aligned with respect to the channel and is supported on the printer.

2 Claims, 3 Drawing Figures

PRINTING DEVICE INCLUDING PIVOTABLE AUXILIARY PAPER FEEDER

BACKGROUND OF THE INVENTION

1. Field of the Invention

The invention relates to a printing device particularly a line printing means, comprising a paper feed channel disposed in a housing for the acceptance and feed of a recording medium to be printed and comprising an auxiliary paper feeder means which can be pivoted into a place on the paper feeding channel.

2. Description of the Prior Art

Apparatus comprising line printing devices are generally known and have been successfully employed. An apparatus for feeding sheets of paper for a printing office machine is disclosed in the German PS No. 28 56 950, this being put in place on the paper feeding shaft of a line printer means and allowing an automatic feed of individual sheets to the printer. In normal operation, for example, with continuous roll paper, the automatic paper feeding means as described is lifted off from the printing device.

Such an emplacement and removal of the auxiliary paper feeder means is unhandy since an additional area is required for the removed apparatus. A quick change between the different operating modes with auxiliary paper feeder means and without auxiliary paper feeder means is therefore complicated. Moreover, the latch devices can be damaged with a removed auxiliary paper feeder means, so that a positionally precise positioning of the auxiliary paper feeder means on the printer becomes impossible over the course of time.

SUMMARY OF THE INVENTION

An object of the invention is to equip a printing device, particularly a line printing device, with an auxiliary paper feeder means which can be disposed positionally precise on the printing device and which enables an easy change between the modes with and without auxiliary paper feeder means.

Using a printing device as described above, this object is achieved in that the auxiliary paper feeder means is pivotably secured to the printing device via a pivot means.

Since the auxiliary paper feeder means, whether it be an automatic sheet feeder means (feeder) or a paper tractor for the transport of marginally-punched continuous form paper, is secured to the printing facility via a vertical axis of rotation, it can be pivoted in and away as a function of the selected operating mode.

The auxiliary paper feeder means can thereby be very simply pivoted out of a paper feeding region of the printer by the user and still remain allocated to the printing device. Only a few additional installation measures need be provided for the printer to accept the paper feeder means. A centering means comprised of interlocking slots and protrusions is provided to ensure precise positioning of the feeder relative to the channel. An actuation device comprised of a handled cam washer is mounted on the pivot to slightly lift the feeder to disengage the centering means to allow the feeder to be pivoted. The auxiliary paper feeder means can also be easily subsequently installed due to the employment of a vertical axis of rotation.

Since the auxiliary paper feeder means need only be pivoted and only a small vertical height adjustment made, the manipulation at the overall printing facility is thereby facilitated. The movably disposed auxiliary paper feeder means guarantees a good accessability of the paper feeding channel after the feeder has been pivoted away, since the paper feeding channel is freely accessible over its entire width.

The overall device is constructed in a simple and cost-favorable fashion.

BRIEF DESCRIPTION OF THE DRAWINGS

An embodiment of the invention is shown in the drawings and shall be described in greater detail below by way of example.

DESCRIPTION OF THE PREFERRED EMBODIMENTS

Figure 1:
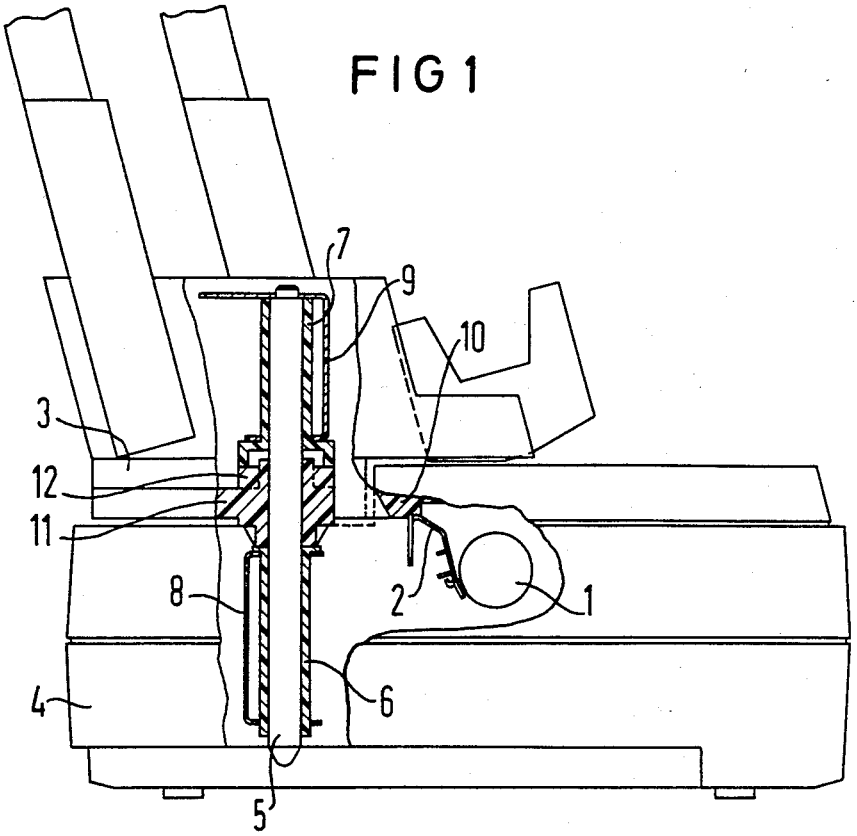
FIG. 1 is a schematic illustration of a printing device with an auxiliary paper feeder means pivotally disposed thereon, being shown partially in a sectional view.

A printing device 4, which is only shown schematically here, contains a print head which is moved along a platen 1 line-by-line during a printing operation. The recording medium to be printed on is thereby supplied via a paper guidance channel 2, whereby a sprocket feed printed stationery, manufactured as continuous form paper, is employed as the recording medium. In order to be able to imprint single sheets using such a printing device in combination with text stations, an auxiliary paper feeder means 3, a so-called feeder, is pivotably disposed on the printer.

The auxiliary paper feeder means 3 is connected to the printing device 4 via a pivot means consisting of a pivot pin having a vertical rotational axis 5 which is guided in vertical plastic guides 6 and 7. The vertical plastic guides 6 and 7 are held in the printer frame 4 and in the auxiliary paper feeder means 3 by stable box type frames 8 and 9 respectively.

In order to properly align the feeder 3 with the printing device 4, the feeder 3 is centered by means of slots 14 in side plates 10 of the feeder 3 engaging protrusions 15 on the paper guidance channel 2 of the printer 4. In the work position illustrated in FIG. 1, with the feeder 3 pivoted into the feeding position, the weight of the feeder 3 is supported by the paper guidance channel 2 through the centering means 14, 15, and, correspondingly, the weight is removed from the pivot pin 5.

The pivot point of the rotational axis 5 is positioned in the printer housing such that the auxiliary feeder 3 can be pivoted laterally away from the work region of the printer 4 in order to make the paper guidance channel 2 free for other types of paper such as sprocket feed printed stationary and single sheet paper, for example, DIN A-3 and larger.

In order for the feeder 3 to be pivoted on the rotational axis away from the work region, the feeder 3 must first be raised such that the centering slots 14 clear the protrusions 15.

Figure 2:
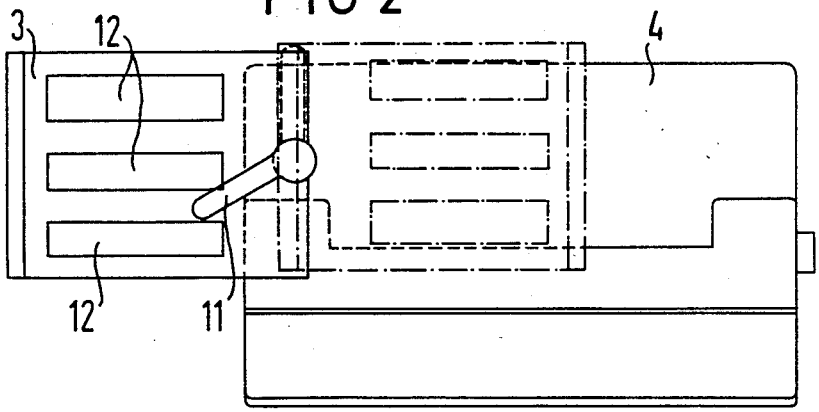
FIG. 2 is a top view of the printing device shown in FIG. 1.
Figure 3:
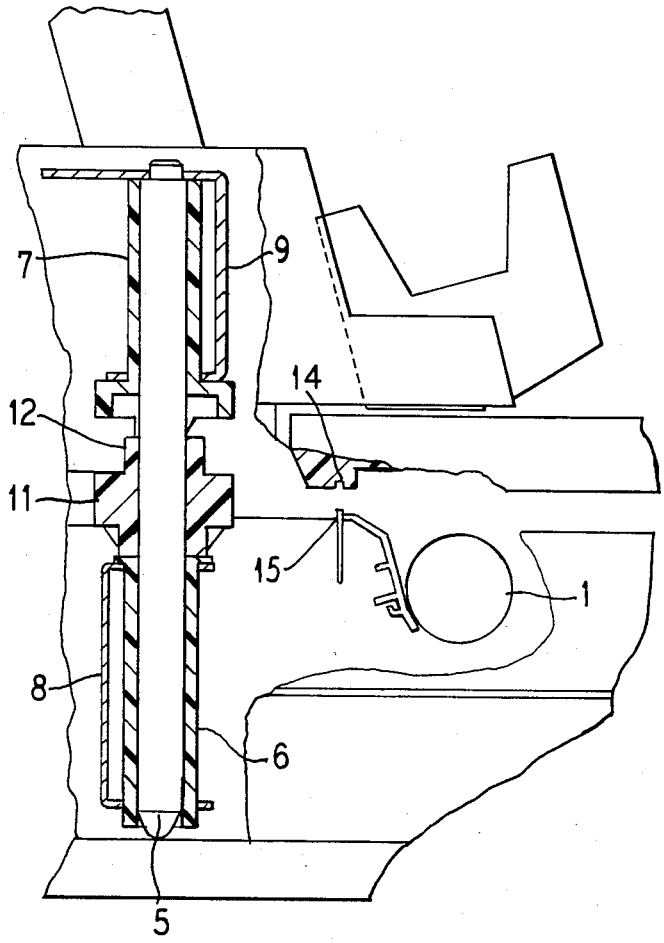
FIG. 3 is a partial sectional view of the printing device with the auxiliary paper feeder in a vertically raised position.

In order to facilitate this lifting and pivoting, an actuation means which raises and lowers the auxiliary paper feeder is provided in the region of the pivot means, the actuation means containing a rotatory lever 11 which is attached to the rotational axis 5. The rotatory lever has a camming piece or washer 12 which is disposed between the plastic guides 6 and 7 and contains a cam surface which rides against a cam surface on at least one of the plastic guides. The auxiliary paper feeder means can only be pivoted given maximum lift, i.e., only after the auxililary paper feeder means has been completely lifted out of the centerings 14, 15 by the rotary movement of lever 11. As seen in FIG. 2, this rotary movement comprises a rotation of the lever 11 of approximately 120°. The vertical rotational axis 5 thereby absorbs the entire weight of the auxiliary paper feeder means 3 in a cantilevered manner.

The pivot operation is illustrated in plan view in FIG. 2, whereby the auxiliary paper feeder means 3 can be pivoted with its paper shafts 13 from the work position shown with broken line 180° into the idle position after the lever 11 has been turned, in order to thus release the paper guidance channel 2. To return the feeder 3 to the work position, it is first pivoted such that the slots 14 overlie the protrusions 15, and then the lever 11 is moved to the rear locking position to lower the feeder 3 onto the printer 4 such that the slots 14 engage the protrusions 15.

As is apparent from the foregoing specification, the invention is susceptible of being embodied with various alterations and modifications which may differ particularly from those that have been described in the preceeding specification and description. It should be understood that I wish to embody within the scope of the patent wearranted hereon all such modifications as reasonably and properly come within the scope of my contribution to the art.

I claim as my Invention:

1. The combination comprising:

a printing device;

said printing device having a housing and a paper feeder channel disposed in said housing for the acceptance and feed of a paper recording medium to be printed;

an auxiliary paper feeder means for feeding paper recording medium into said channel;

a single vertical axis pivot pin interconnecting said printing device and said feeder means to provide lateral pivoting of said feeder means relative to said printing device;

said vertical axis pivot pin being received in guide members in said printing device and said feeder means;

a centering means comprising inter fitting slots and protrusions on said feeder means and said printing device to align, support and retain said feeder means over said feeding channel in a work position; and an actuation means comprising a cam washer on said pivot pin independent from and interposed between said guide members and rotatable on said pivot pin by means of an extending handle portion and having a cam surface to interact with a surface on at least one of said guide members such that said feeder means is lifted from said printing device upon rotation of said cam washer to selectively vertically engage and disengage said centering means;

whereby, said centering means may be vertically disengaged allowing said feeder means to then be laterally pivoted away from said feeding channel.

2. The device of claim 1 wherein said guide members comprise plastic sleeves secured in box-type frame members mounted in said printing device and said feeder means.

* * * * *